US010214041B2

(12) United States Patent
Tamblyn et al.

(10) Patent No.: US 10,214,041 B2
(45) Date of Patent: Feb. 26, 2019

(54) METHOD AND APPARATUS FOR PRINTING A SECURITY CARD

(71) Applicant: Magicard Ltd, Weymouth (GB)

(72) Inventors: Christian Tamblyn, Dorset (GB); Andrew Michael Pass, Dorset (GB)

(73) Assignee: MAGICARD LTD, Dorset (GB)

( * ) Notice: Subject to any disclaimer, the term of this patent is extended or adjusted under 35 U.S.C. 154(b) by 0 days.

(21) Appl. No.: 15/562,450

(22) PCT Filed: Mar. 24, 2016

(86) PCT No.: PCT/GB2016/050855
§ 371 (c)(1),
(2) Date: Sep. 28, 2017

(87) PCT Pub. No.: WO2016/156818
PCT Pub. Date: Oct. 6, 2016

(65) Prior Publication Data

US 2018/0086125 A1 Mar. 29, 2018

(30) Foreign Application Priority Data

Mar. 31, 2015 (GB) ..... 1505524.7

(51) Int. Cl.
*B41J 2/325* (2006.01)
*B41M 5/382* (2006.01)
(Continued)

(52) U.S. Cl.
CPC ..... *B41M 5/38257* (2013.01); *B41F 16/0026* (2013.01); *B41J 2/325* (2013.01);
(Continued)

(58) Field of Classification Search
CPC .. B41F 16/00; B41F 16/0006; B41F 16/0026; B41F 16/0033; B41J 2/315; B41J 2/32; B41J 2/325
See application file for complete search history.

(56) References Cited

U.S. PATENT DOCUMENTS

2004/0075730 A1 4/2004 Tsuruta
2009/0074948 A1 3/2009 Keiji et al.
(Continued)

FOREIGN PATENT DOCUMENTS

EP 1193080 A2 4/2002
EP 1342584 A1 9/2003
(Continued)

OTHER PUBLICATIONS

Ultra Electronics: "Prima 4 User Manual—Magicard Support | UltraID", Apr. 15, 2014, retrieved from https://support.magicard.com/solution/prima-4-user-manual/, entire document.
(Continued)

*Primary Examiner* — Kristal Feggins
(74) *Attorney, Agent, or Firm* — Meunier Carlin & Curfman LLC

(57) ABSTRACT

The present invention relates to methods and apparatus for printing a security card. A security image is printed onto the receiving layer of a dye receptive reverse transfer film, which can then be applied to the card and bonded with the card. The printing of the security image occurs by transferring overcoat material from an overcoat panel of the dye carrying film onto the receiving layer of the dye receptive reverse transfer film in a pattern, which forms the visual security image. This process can be used in conjunction with the printing of a primary image by printing Yellow, Magenta, Cyan dyes and Black resin (YMCK) to the receiving layer in a reverse transfer printing method to provide a security card having a primary image and a security image. The
(Continued)

security image printing may occur before or after the YMCK printing.

25 Claims, 7 Drawing Sheets

(51) Int. Cl.
*B41M 3/14* (2006.01)
*B42D 25/23* (2014.01)
*B42D 25/45* (2014.01)
*B41F 16/00* (2006.01)

(52) U.S. Cl.
CPC ..... *B41M 3/144* (2013.01); *B41M 3/148* (2013.01); *B42D 25/23* (2014.10); *B42D 25/45* (2014.10); *B41M 2205/10* (2013.01); *B41M 2205/32* (2013.01)

(56) References Cited

U.S. PATENT DOCUMENTS

2010/0220170 A1 9/2010 Mori
2012/0176460 A1 7/2012 Mochizuki et al.
2012/0286464 A1 11/2012 Takei et al.
2013/0167742 A1 7/2013 Tamura et al.
2014/0139606 A1 5/2014 Sakai et al.

FOREIGN PATENT DOCUMENTS

EP 1468831 A1 10/2004
WO 99/55530 A1 11/1999

OTHER PUBLICATIONS

Issue 1.02 Ultra Electronics Card Systems: "Prima 4 User Manual", Apr. 15, 2014, retrieved from http://ultraid.force.com/download/servlet/servlet.FileDownload?file=00Pd000000AbrWKEAZ, pp. 7-11, 15, 16, and 87-119.

International Search Report dated Jul. 5, 2016, from International Application No. PCT/GB2016/050855, 4 pages.

Written Opinion dated Jul. 5, 2016, from International Application No. PCT/GB2016/050855, 6 pages.

Search Report under Section 17(5) dated Sep. 28, 2015, from Application No. GB1505524.7, 6 pages.

METHOD AND APPARATUS FOR PRINTING A SECURITY CARD

CROSS REFERENCE TO RELATED APPLICATIONS

This application is a national stage application filed under 35 U.S.C. § 371 of PCT/GB2016/050855, filed Mar. 24, 2016, which claims the benefit of British Patent Application No. 1505524.7, filed Mar. 31, 2015. The disclosures of each of these applications are incorporated by reference in their entireties.

FIELD OF THE INVENTION

The present invention relates to methods and apparatus for printing a security card. In particular, the present invention relates to a method of printing a visual security image for applying to a security card, a method of applying a visual security image to a security card, a method of printing a security card, and a printer for printing a security card.

BACKGROUND OF THE INVENTION

Various methods can be used to print an image onto plastic card based media, for example security cards. One method is thermal transfer printing, of which there are generally two types: direct to card and reverse transfer. Direct to card is where images are transferred from a dye film directly into the plastic card surface. Reverse transfer is where images are transferred from a dye carrying film to a reverse transfer film in order to build up a composite image. This composite image is then transferred to, and bonded with, the plastic card in a second process.

Methods exist in creating a second image on the card in addition to the normal, or primary, printed image for direct to card printing processes. This second image is often used as a security feature, in that it provides additional assurance that the printed card is genuine. Examples of a second image include watermarks, UV images, holographic images, and optically variable devices.

However, in the field of reverse transfer printing, few methods of creating a second image are available. Of the methods watermarks, UV images, holographic images, and optically variable devices, UV images are available as part of the reverse transfer process, and this has limitations in that it's not a truly secure method, since the method may easily be copied. It is also possible to purchase specially pre-printed holographic reverse transfer film. These films are expensive to prepare to manufacture and also the piece part cost is high. They are inflexible (once you have specified your design you are stuck with it unless you order a new film design). The security of these films is also suspect, as it would only require someone to obtain a roll of the film fraudulently to be able to apply the holographic reverse transfer film. The other methods are not currently available with reverse transfer printing, and where applied have to be done to the card either at card manufacturing or by a further lamination process after card printing.

It would be advantageous to provide a method of printing a second image, such as a visual security image, within the reverse transfer printer, at the time of printing the normal, or primary, image. It would provide further benefit in being able to make that second image a secure image that cannot be readily reproduced.

SUMMARY OF THE INVENTION

The present invention therefore provides a method of printing a visual security image for applying to a security card, comprising: receiving a visual security image to be printed; printing the visual security image onto a receiving layer of a dye receptive reverse transfer film by transferring overcoat material from an overcoat panel of a dye carrying film onto the receiving layer of the dye receptive reverse transfer film in a pattern, the pattern forming the visual security image.

Using this method, a visual security image may be applied using a reverse transfer printing process, which facilitates easier manufacture of printed security cards having an identifiable visual security image. By printing the visual security image as described, the visual security image can be viewed in visible light, doesn't affect the way it fluoresces under UV, and, because it is an overcoat material, it doesn't decrease the life of the security card (when applied) due to light-fastness.

Printing the visual security image onto the receiving layer may comprise heating a print-head of a printer and applying pressure from the print-head to the overcoat panel, the heat and pressure being sufficient to transfer desired portions of overcoat material from the overcoat panel onto the receiving layer to form the pattern. This technique provides a more covert security image.

Additionally, printing the visual security image onto the receiving layer may comprise heating a print-head of a printer and applying pressure from the print-head to the overcoat panel, the heat and pressure being sufficient to transfer desired portions of overcoat material and overcoat panel receiving layer from the overcoat panel onto the receiving layer of the reverse transfer film to form the pattern, where the overcoat panel receiving layer carries the overcoat material on the dye carrying film. This technique provides a more visible (in normal lighting conditions) security image compared to the above technique.

Furthermore, printing the visual security image onto the receiving layer may also comprise dithering the print-head to produce a dithered pattern, the dithered pattern forming the visual security image. This enables complex patterns and shading to be implemented in the visual security image.

Printing the visual security image onto the receiving layer may comprise using a model to control the heating of the print-head during printing, the model defining heat energy properties of each of a plurality of printing elements comprising the print-head of the printer. This enables a higher quality image to be printed onto the reverse transfer film compared to the above techniques.

The visual security image may be encrypted with an encryption key for preventing unauthorised printing of the visual security image. As such, printing of a visual security image may be limited to a particular printer (to guarantee authenticity of the security image being printed for applying to cards) that is authorised to do so. When authorised to print the encrypted visual security image, receiving a visual security image to be printed may comprise receiving the encrypted visual security image, and decrypting the encrypted visual security image using a decryption key stored local to the printer being used to print the security image prior to printing the visual security image.

The present invention also provides a method of applying a visual security image to a security card, comprising: printing a visual security image onto a receiving layer of a dye receptive reverse transfer film according to any of the above methods; transferring the reverse transfer film to a surface of a security card; and bonding the reverse transfer film to the security card.

The present invention also provides a method of printing a security card, comprising: receiving a primary image and a visual security image to be printed on the security card; printing the primary image onto a receiving layer of a dye receptive reverse transfer film; printing the visual security image onto the receiving layer of the dye receptive reverse transfer film according to any of the above methods; transferring the reverse transfer film to a surface of the security card; and bonding the reverse transfer film to the security card.

Such a technique provides a method of printing a card having a primary image (for example an image of the card bearer, and/or some other identifying data pertaining to the card bearer) together with a visual security image that identifies the card as being a genuine card provided by an entity such as an employer or government agency or the like.

Printing the primary image onto the receiving layer may comprise heating a print-head and applying pressure from the print-head to each of a Yellow, Magenta, Cyan, and Black (YMCK) panels of the dye carrying film in sequence, the heat and pressure being sufficient to transfer desired portions of each of the YMCK dyes from the respective YMCK panels onto the receiving layer to form the printed primary image on the receiving layer.

In the above method, printing of the primary image may occur before printing of the visual security image. Alternatively, printing of the visual security image may occur before printing of the primary image.

The present invention also provides a security card obtained by the above methods.

The present invention also provides a printer for printing a security card, comprising: a controllable thermal print-head; a controllable dye receptive reverse transfer film receiver for supporting a dye receptive reverse transfer film relative to the print-head; a controllable dye carrying film receiver for supporting a dye carrying film between the print-head and the dye receptive transfer film, the dye carrying film comprising Yellow, Magenta, Cyan, Black and Overlay (YMCKO) panels; and a controller coupled to the thermal print-head, dye carrying film receiver and dye receptive reverse transfer film receiver, the controller being configured to: receive a primary image and a visual security image to be printed on the security card; print the primary image onto a receiving layer of a dye receptive reverse transfer film; print the visual security image onto the receiving layer of the dye receptive reverse transfer film by transferring overcoat material from the overcoat panel of the dye carrying film onto the receiving layer of the dye receptive reverse transfer film in a pattern, the pattern forming the visual security image; transfer the reverse transfer film to a surface of a security card; and bond the reverse transfer film to the security card.

Such a printer enables a security card to be printed, where the security card has a primary image (for example an image of the card bearer, and/or some other identifying data pertaining to the card bearer) together with a visual security image that identifies the card as being a genuine card provided by an entity such as an employer or government agency or the like. Using such a printer, the visual security image may be applied using a reverse transfer printing process, which facilitates easier manufacture of printed security cards having an identifiable security image. By printing the visual security image as described, the security image can be viewed in visible light, doesn't affect the way it fluoresces under UV, and, because it is an overcoat material, it doesn't decrease the life of the security card (when applied) due to light-fastness.

The controller may be configured to print the visual security image onto the receiving layer by heating the print-head and applying pressure from the print-head to the overcoat panel, the heat and pressure being sufficient to transfer desired portions of overcoat material from the overcoat panel onto the receiving layer to form the pattern. This technique provides a more covert security image.

Additionally, the controller may also be configured to print the visual security image onto the receiving layer by heating the print-head and applying pressure from the print-head to the overcoat panel, the heat and pressure being sufficient to transfer desired portions of overcoat material and overcoat panel receiving layer from the overcoat panel onto the receiving layer of the reverse transfer film to form the pattern, where the overcoat panel receiving layer carries the overcoat material on the dye carrying film. This technique provides a more visible (in normal lighting conditions) compared to the above technique.

Furthermore, the controller may be configured to print the visual security image onto the receiving layer by dithering the print-head to produce a dithered pattern, the dithered pattern forming the visual security image. This enables complex patterns and shading to be implemented in the security image.

The controller may use a model to control the heating of the print-head during printing, the model defining heat energy properties of each of a plurality of printing elements comprising the print-head of the printer. This enables a higher quality image to be printed onto the reverse transfer film compared to the above techniques.

The visual security image may be encrypted with an encryption key for preventing unauthorised printing of the visual security image. As such, printing of a visual security image may be limited to a particular printer (to guarantee authenticity of the security image being printed for applying to cards) that is authorised to do so. When authorised to print the encrypted visual security image, the controller may be configured to decrypt the encrypted visual security image using a decryption key stored local to the printer prior to printing the security image.

The controller may be configured to print the primary image onto the receiving layer by heating the print-head and applying pressure from the print-head to each of the Yellow, Magenta, Cyan, and Black (YMCK) panels of the dye carrying film in sequence, the heat and pressure being sufficient to transfer desired portions of each of the YMCK dyes from the respective YMCK panels onto the receiving layer to form the printed primary image on the receiving layer.

The printer may print the primary image before printing the visual security image. Alternatively, the printer may print the visual security image before printing the primary image.

LIST OF FIGURES

The present invention will now be described, by way of example only, and with reference to the accompanying figures, in which.

Figure 10A:
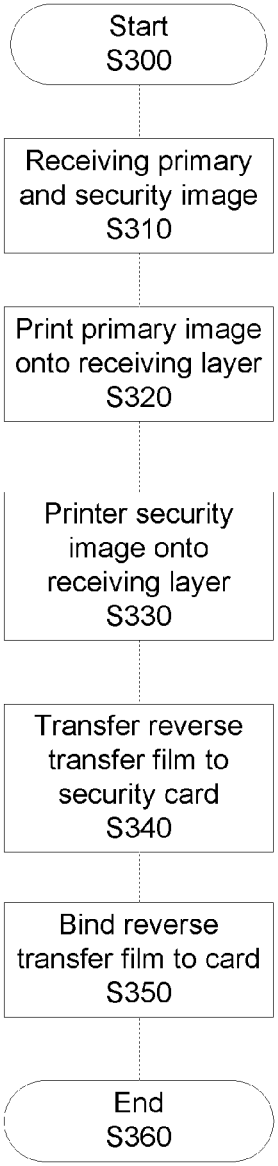
Figure 10B:
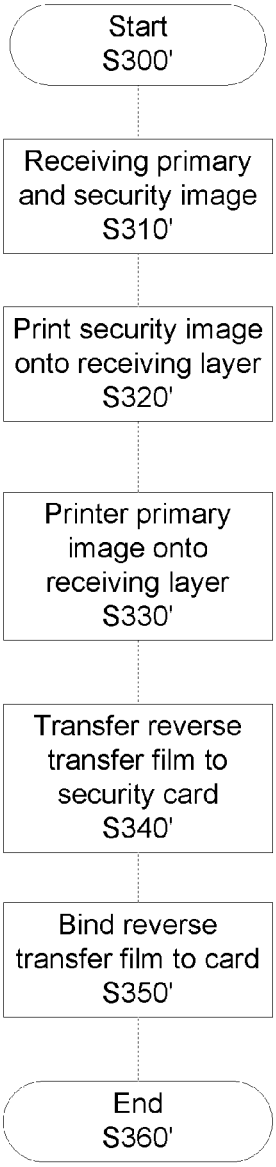
Figure 11:
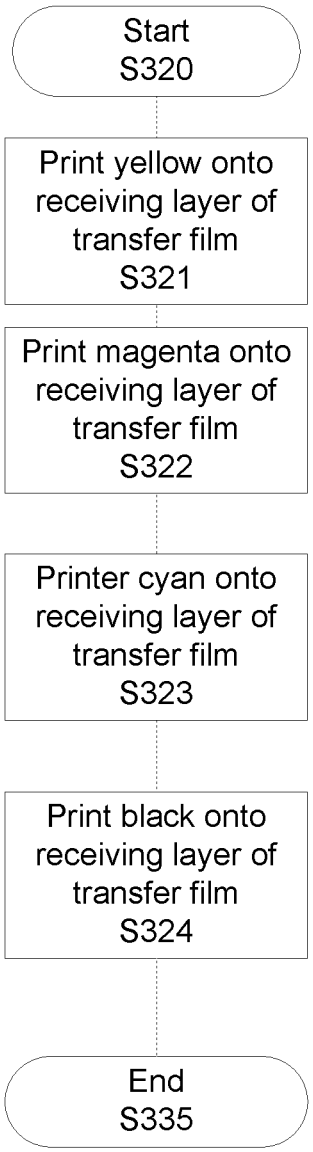
Figure 12:
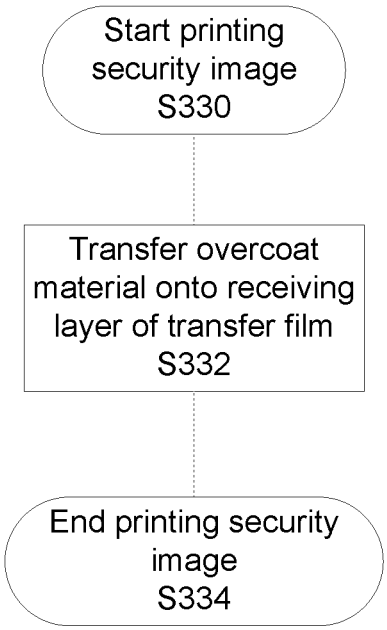

FIGS. 10*a* and 10*b* show methods of printing a security card having a primary and security image;

FIG. 11 shows the steps of printing the YMCK dyes for FIGS. 10*a* and 10*b*; and FIG. 12 shows the steps of printing security image for FIGS. 10*a* and 10*b*.

DETAILED DESCRIPTION OF THE PREFERRED EMBODIMENTS

In brief, the present invention provides a method of printing a visual security image for applying the visual security image to a security card where the security image is printed onto the receiving layer of a dye receptive reverse transfer film, which can then be applied to the card and bonded with the card. The printing of the security image occurs by transferring overcoat material from an overcoat panel of the dye carrying film onto the receiving layer of the dye receptive reverse transfer film in a pattern, which forms the visual security image. This process can be used in conjunction with the printing of a primary image by printing Yellow, Magenta, Cyan dyes and Black resin (YMCK) to the receiving layer in a reverse transfer printing method to provide a security card having a primary image and a security image. The security image printing may occur before or after the YMCK printing.

Figure 1:
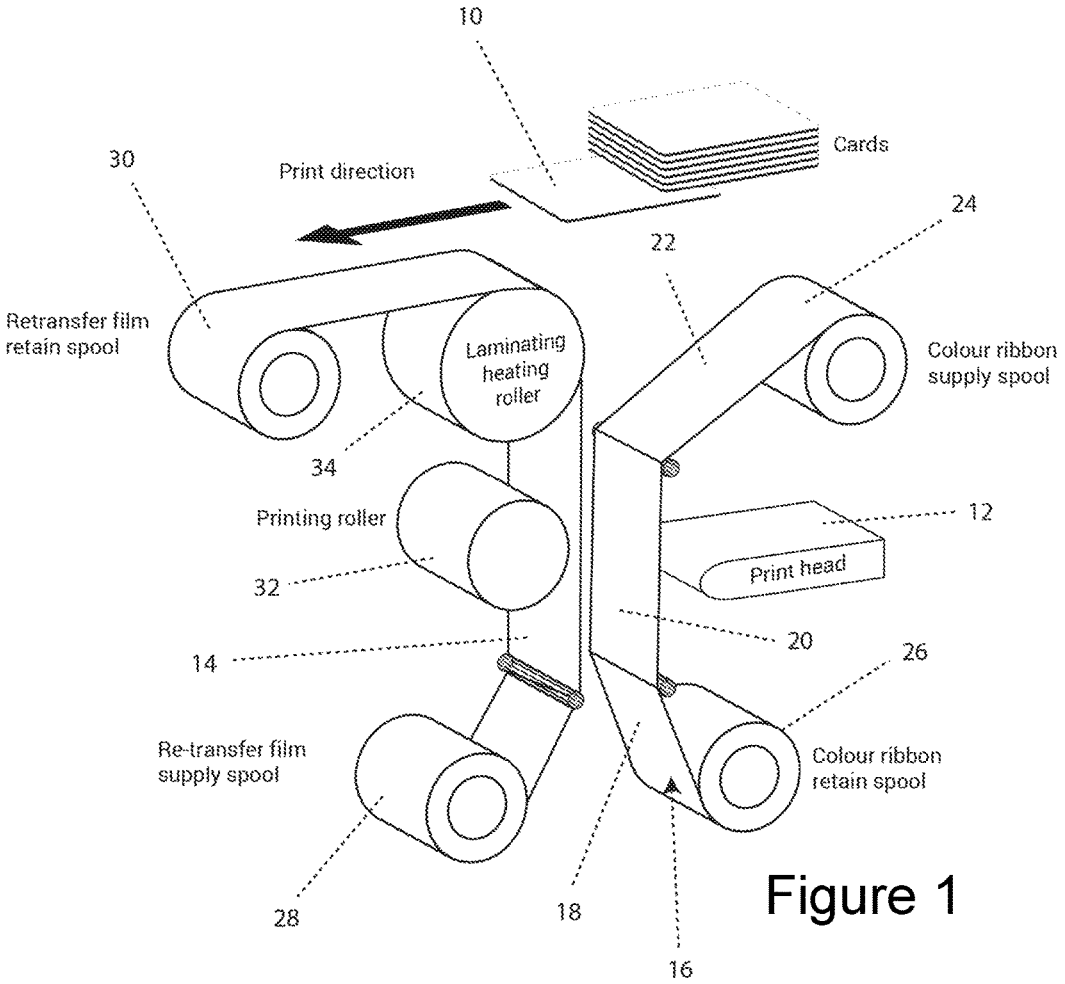
FIG. 1 shows a reverse transfer printing process for printing a security card.

With reference to FIG. 1, we will briefly describe the reverse transfer printing process for printing a security card. Reverse transfer printing is a technique whereby an image is printed onto a dye-receptive transfer film 14 and then this film is fused onto the surface of a card 10. The dye-receptive reverse transfer film 14 is suspended between two rotatable rollers 28, 30 and receives dye from a dye-carrying film 16, which is suspended on two rotating rollers 24, 26. On the dye-carrying film is a plurality of dye panels 18, 20, 22, each panel carrying a different colour: Yellow, Magenta, Cyan dyes and a Black resin (YMCK).

The dye-carrying film comprises 3 layers: a PET base substrate, a releasing layer and a third layer which is either YMC ink or K (Black) resin. The purpose of the releasing layer is to allow colour ink (or resin) to be released from the base layer without bulk transfer of the ink layer occurring. It also has to allow bulk transfer of the resins, and it acts as a bonding agent between the base layer and the layers to be released.

The image is printed on the reverse transfer film 14 by heating the (preferably ceramic) print-head 12 and applying pressure to the dye-carrying film 16 and dye-receptive reverse transfer film 14 against the printing roller 32 for each of the YMCK panels to build up a composite image on the dye-receptive reverse transfer film.

This composite image is then transferred to the card 10 and bonded to the card 10 via the laminating heating roller 34, before being ejected from the printer.

Figure 2:
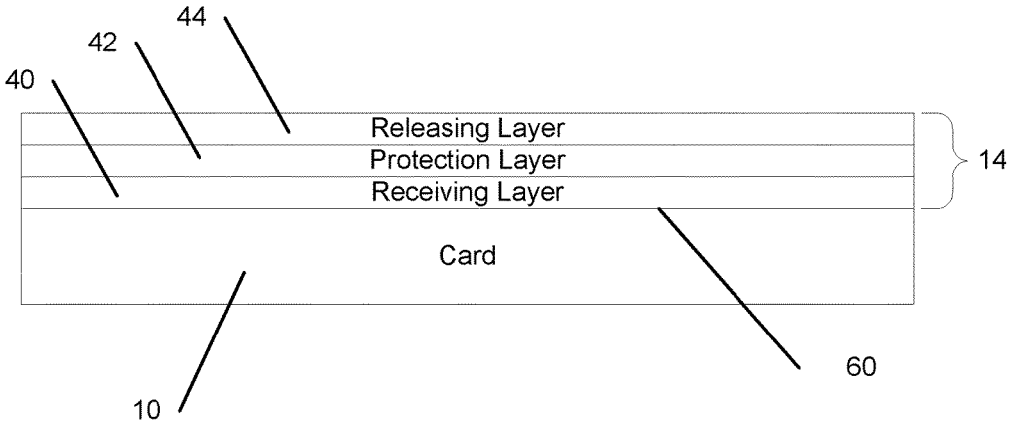
FIG. 2 shows a cross section of a security card having had the reverse transfer film applied thereto.

FIG. 2 shows a cross section of a card 10 having had the reverse transfer film 14 applied thereto prior to the releasing layer being removed.

The reverse transfer film 14 has 4 layers: dye receiving 40, protective 42, releasing 44 and PET base (not shown in FIG. 2, as this base does not get applied to the card 10). The image is printed onto the dye-receiving layer and then this layer and the protective layer are adhered to the card using a heated roller, where the releasing layer is peeled off.

Figure 3:
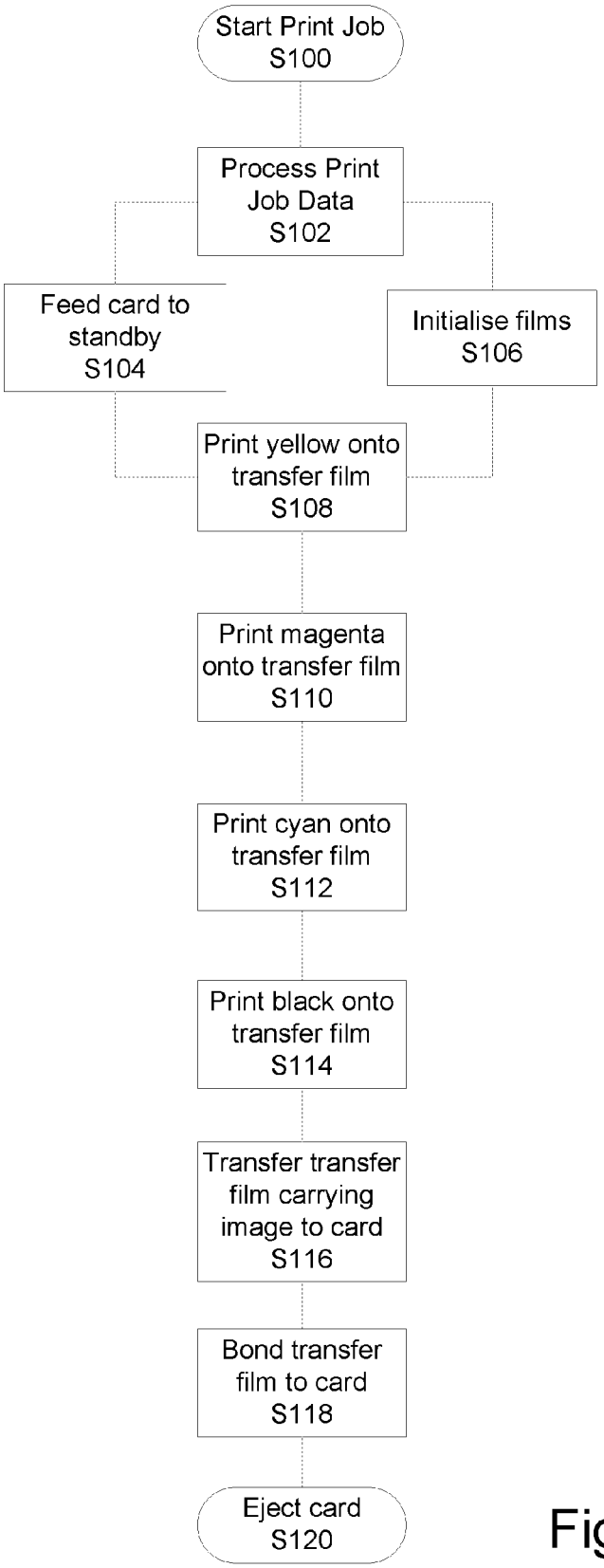
FIG. 3 shows a method of a reverse transfer printing process.

FIG. 3 shows the basic flow chart of the printing process described above. Once the print job data (for example data defining the primary image to be printed and any other characteristics of the card to be used, where the primary image for example can be a photo of the intended wearer, or any other identifying data related to the intended wearer, or other data) is received and processed in S102, the card 10 is fed into a standby position S104 and the films 14, 16 are initialised. The yellow panel of the dye-carrying film 16 is printed to the receiving layer 40 of the dye-receiving film 14 S108, then the magenta colour S110, then cyan S112 and then the black S114. Once the composite images that form the primary image has been formed on the receiving layer 40 of the dye-carrying reverse transfer film 14, the printed portion of reverse transfer film is transferred to the surface of the card 10 in S116 and then bonded to the card in S118. Once the card is finished, the card is ejected from the printer S120.

In accordance with the present invention, the end user of the printer is able to print plastic cards with a visual security image (VSI) across the surface of the card using a reverse transfer printing method. The VSI is an additional image to the primary image discussed above.

Figure 4:
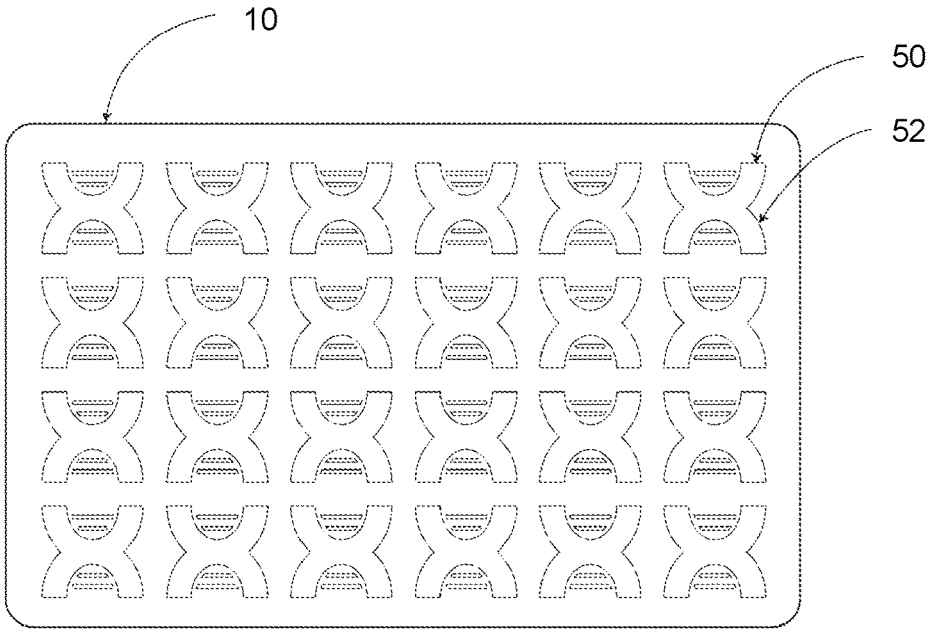
FIG. 4 shows a security image applied to a security card.
Figure 5:
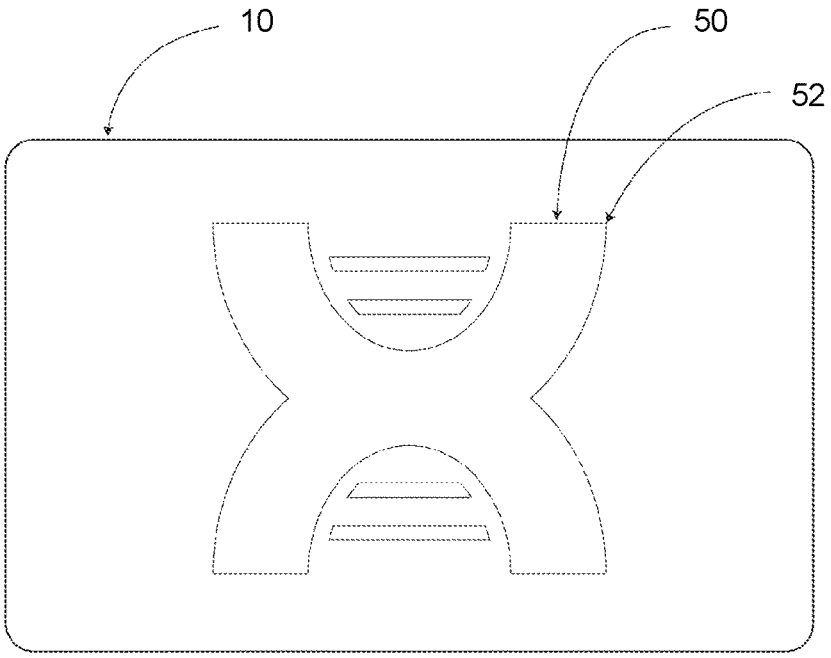
FIG. 5 shows an alternative security image applied to a security card.
Figure 6:
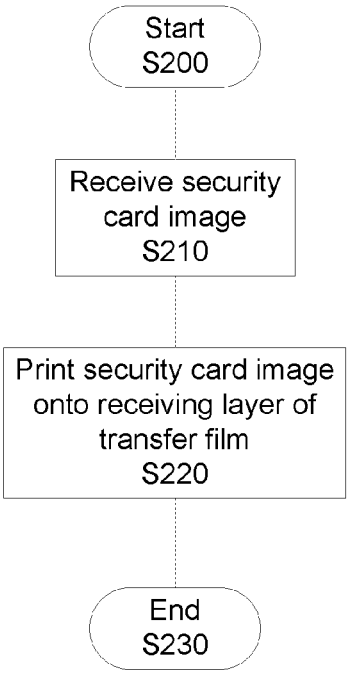
FIG. 6 shows a method of printing a security card image.
Figure 7:
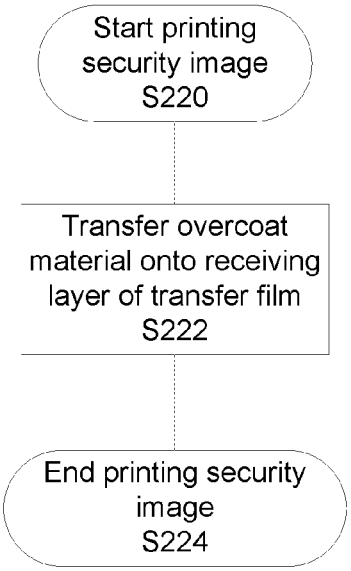
FIG. 7 shows the method of FIG. 6 is more detail.

When the printed card is viewed by the naked eye, the visual security image is seen as a semi-transparent image on top of the normal, or primary, printed image (P1) on the card. The visual security image is distinct, but does not interfere with viewing the printed image. Some examples are shown in FIGS. 4 and 5, which show different designs of a visual security image 52 (having an outline 50) applied to a card 10.

The VSI can be customised, by the printer manufacturer, so that it is a specific image chosen by the end user. This will typically be a corporate logo, a government logo, or other image which is proprietary to the end user. In this case when the VSI is a custom image, the ability to print that image may be programmed into each individual printer. This means that only the printers owned by the end user will print their specific VSI, which is a security benefit. This will be described in more detail below.

The VSI can also be produced by the printer using a number of standard designs built into the printer's memory. A printer will typically offer 4 or 5 standard designs. These allow the end user to see what the effect looks like before applying a final design to a batch of cards.

The VSI will fluoresce when viewed under a UV light, which makes it easier to see. For example, a security guard with a UV light can check a card, and the clearly seen fluorescing image is a quick confirmation of the authenticity of the card.

The VSI can be produced in more overt or more covert variants, to suit end user preferences.

The VSI can be produced with a greyscale effect, allowing finer details of the image to be printed and viewed. This is advantageous for highly detailed images such as some government seals.

Prior art methods of applying a VSI exist where a colour ribbon with a clear fluorescent panel (YMCK-UV ribbon) can be used to print characters and images visible only when illuminated by UV light. This method has limitations where one cannot print these UV images in areas where colour has been printed because 1) The YMC ink reduces the fluorescence of the security image and 2) The fluorescent ink reduces the light-fastness of the colour inks.

The VSI method used in the present invention is better because: 1) It can be viewed in visible light, 2) The colour image doesn't affect the way it fluoresces under UV and 3)

Because it is ordinary overcoat it doesn't decrease the life of the card due to light-fastness.

The method of printing and applying the VSI to a card will now be described with reference to FIGS. 6 to 12.

The VSI is produced by using a special dye-carrying film 16 with an Overcoat (O) panel. This kind of film is not normally used in reverse transfer printing.

In its broadest form, the method of printing the VSI comprises receiving a visual security image to be printed S210 and then printing the visual security image onto the receiving layer 40 of the dye receptive reverse transfer film 14 by transferring overcoat material from the overcoat panel of the dye-carrying film 16 onto the receiving layer 40 of the dye receptive reverse transfer film 14 in a pattern S222. The pattern forms the visual security image.

In order to transfer the overcoat material, any of the following techniques may be applied:

Uniform Deposit

Each pixel of the specially designed VSI is printed onto the reverse transfer film 14 from the overcoat panel using heat and pressure from the ceramic print head 12. These overcoat resin deposits are almost completely transparent, and only become visible once a card containing the transferred image is tilted at the correct angle, or when viewed using a UV light source. This is the most covert method.

Overheated Deposit

In this method the pixels of the image are deposited using more heat than in the uniform deposit method. As discussed above, the dye-carrying film comprises 3 layers: a PET base substrate, a releasing layer and a third layer which is either YMC ink or resin (overcoat or black). When the overcoat panel is overdriven (i.e. more heat applied to the dye-carrying film than would ordinarily be used to transfer the overcoat resin to the receiving layer of the reverse transfer film) some of the releasing layer is also transferred from the overcoat panel as well as the overcoat resin. These deposits are less transparent than the uniform deposits and are much easier to see on the transferred image without tilting the card.

Composite Deposit

This method uses a mixture of the uniform and overheated techniques to create more complicated designs of VSI, with some parts of the image only revealed when the card is tilted.

Dithering

Using a combination of uniform and overheated deposits 'grey scale' images can be produced by applying a dithering process to the pixels within a VSI.

When applied to a card having a primary image printed using the reverse transfer printing techniques using YMCK dyes/resins as described above, the VSI may be applied above or below the primary image.

Figure 8:
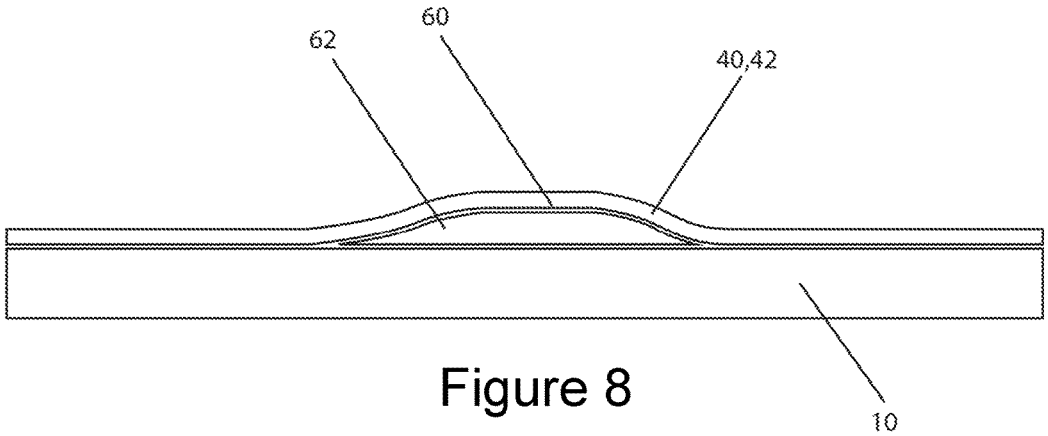
FIG. 8 shows a cross section card having a primary and security image applied thereto.

FIG. 8 shows an example cross section of a card where the VSI 62, once applied to the card 10, is below the image 60, both of which have been applied to the receiving layer 40 of the dye receiving reverse transfer film 14 before being bonded to the card. In this structure, the primary image 60 is printed first, before the VSI is applied using the techniques described above.

Figure 9:
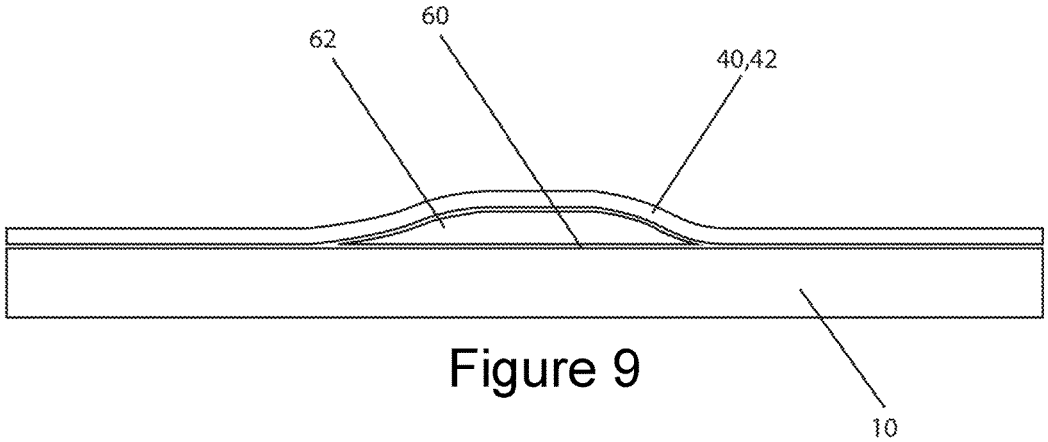
FIG. 9 shows a cross section card having a primary and security image applied thereto.

FIG. 9 shows an alternative arrangement to that of FIG. 8, in that the VSI 62, once applied to the card 10, is above the image 60, both of which have been applied to the receiving layer 40 of the dye receiving reverse transfer film 14 before being bonded to the card. In this structure, the VSI 62 is printed first using the techniques described above, before the primary image 60 is printed using the techniques described above.

Both of the above arrangements will influence the way in which the VSI and primary image appear to the user, as the incident light is filtered and fluoresces and changes the appearance of the VSI.

The visibility of all of these VSIs is due to a mixture of fluorescence, refraction, reflection and filtering. Varying the amount that incident light is modified by the deposited image alters its visibility and makes the feature more or less covert.

A major challenge of this technology is to make the VSI clearly visible while maintaining the integrity of the image itself. i.e.: the more overcoat resin you deposit, the easier it is to see, but the finer details of the image may be lost. In order to avoid such problems, specially developed algorithms are used to analyse the VSI data and model how heat energy will flow into and out of each printing element of the thermal print head during the course of the printing process; these computations are used to adjust how the print head is driven in order to produce a faithful representation on the printed card.

FIGS. 10*a* and 10*b* show the process of printing a security card 10 having a primary image and visual security image, where the primary and visual security images are received S310, the primary image is printed S320 on the reverse transfer film (as described above), the visual security image is printed S330 on the reverse transfer film (as described above), the reverse transfer film is transferred to the card S340 and the reverse transfer film is bound to the card S350.

FIGS. 10*a* and 10*b* are substantially similar and vary from one another only in that the primary and visual security images are printed in different orders between the two methods.

FIG. 11 details the method of printing the primary image in FIGS. 10*a* and 10*b*, using the YMCK panels (as described above), where the yellow S321, magenta S322, cyan S323 dyes and black S324 resin are printed each in turn on the receiving layer of the reverse transfer film to create the composite image to form the primary image.

FIG. 12 details the method of printing the security image in FIGS. 10*a* and 10*b* using the overcoat panel (as described above), where the overcoat material S332 is transferred onto the receiving layer of the reverse transfer film to create a pattern that forms the visual security image.

Since the VSI may be customised, by the printer manufacturer, so that it is a specific image chosen by the end user (for example a corporate logo, a government logo, or other image which is proprietary to the end user), it is advantageous to use means to ensure that the VSI cannot be obtained and used fraudulently on other printers. This gives the user confidence that the card being used can only be printed with the desired VSI by a limited number of printers, so the cards carrying the VSI can be known as genuine.

As such, one mechanism that may be employed with the present invention is that the visual security image is encrypted using an encryption key. In order for the visual security image to be printed on a printer, the encrypted security image must first be decrypted. Measures may then be put in place to limit how and in what circumstances the printer may decrypt the encrypted VSI. For example, the printer may be programmed to access a decryption key local to the printer, for example a decryption key stored in the printer memory or stored on an internal company communications network. The decryption key may for example only be accessed or used by certain printers (identified by unique properties to that printer), or only accessed or used by certain printers on a particular internal company communications network (for example an internal network subdomain). Other ways of limiting access to and use by a printer for the decryption key may be apparent to those skilled in the art.

No doubt many other effective alternatives will occur to the skilled person. It will be understood that the invention is not limited to the described embodiments and encompasses modifications apparent to those skilled in the art lying within the scope of the claims appended hereto.

The invention claimed is:

1. A method of printing a visual security image for applying to a security card, comprising:

receiving a visual security image to be printed;

printing the visual security image onto a receiving layer of a dye receptive reverse transfer film by transferring overcoat resin from an overcoat panel of a dye carrying film onto the receiving layer of the dye receptive reverse transfer film in a pattern, the pattern forming the visual security image.

2. A method according to claim 1, wherein printing the visual security image onto the receiving layer comprises heating a print-head of a printer and applying pressure from the print-head to the overcoat panel, the heat and pressure being sufficient to transfer desired portions of overcoat resin from the overcoat panel onto the receiving layer to form the pattern.

3. A method according to claim 2, wherein printing the visual security image onto the receiving layer comprises dithering the print-head to produce a dithered pattern, the dithered pattern forming the visual security image.

4. A method according to claim 2, wherein printing the visual security image onto the receiving layer comprises using a model to control the heating of the print-head during printing, the model defining heat energy properties of each of a plurality of printing elements comprising the print-head of the printer.

5. A method according to claim 2, wherein printing the visual security image onto the receiving layer comprises heating a print-head of a printer and applying pressure from the print-head to the overcoat panel, the heat and pressure being sufficient to transfer desired portions of overcoat resin and overcoat panel receiving layer from the overcoat panel onto the receiving layer of the reverse transfer film to form the pattern, where the overcoat panel receiving layer carries the overcoat resin on the dye carrying film.

6. A method according to claim 1, wherein printing the visual security image onto the receiving layer comprises heating a print-head of a printer and applying pressure from the print-head to the overcoat panel, the heat and pressure being sufficient to transfer desired portions of overcoat resin and overcoat panel receiving layer from the overcoat panel onto the receiving layer of the reverse transfer film to form the pattern, where the overcoat panel receiving layer carries the overcoat resin on the dye carrying film.

7. A method according to claim 1, wherein the visual security image is encrypted with an encryption key for preventing unauthorized printing of the visual security image.

8. A method according to claim 7, wherein, when authorized to print the encrypted visual security image, receiving a visual security image to be printed comprises receiving the encrypted visual security image, and decrypting the encrypted visual security image using a decryption key stored local to the printer being used to print the visual security image prior to printing the visual security image.

9. A method of applying a visual security image to a security card, comprising:

printing a visual security image onto a receiving layer of a dye receptive reverse transfer film according to the method of claim 1;

transferring the reverse transfer film to a surface of a security card; and bonding the reverse transfer film to the security card.

10. A method of printing a security card, comprising:

receiving a primary image and a visual security image to be printed on the security card;

printing the primary image onto a receiving layer of a dye receptive reverse transfer film;

printing the security image onto the receiving layer of the dye receptive reverse transfer film according to the method of claim 1;

transferring the reverse transfer film to a surface of the security card; and bonding the reverse transfer film to the security card.

11. A method according to claim 10, wherein printing the primary image onto the receiving layer comprises heating a print-head and applying pressure from the print-head to each of a Yellow, Magenta, Cyan, and Black (YMCK) panel of the dye carrying film in sequence, the heat and pressure being sufficient to transfer desired portions of each of the YMCK dyes from the respective YMCK panels onto the receiving layer to form the printed primary image on the receiving layer.

12. A method according to claim 10, wherein printing of the primary image occurs before printing of the visual security image.

13. A method according to claim 10, wherein printing of the visual security image occurs before printing of the primary image.

14. A security card obtained by the method according to claim 10.

15. A printer for printing a security card, comprising:

a controllable thermal print-head;

a controllable dye receptive reverse transfer film receiver for supporting a dye receptive reverse transfer film relative to the print-head;

a controllable dye carrying film receiver for supporting a dye carrying film between the print-head and the dye receptive transfer film, the dye carrying film comprising Yellow, Magenta, Cyan, Black and Overcoat (YMCKO) panels; and a controller coupled to the thermal print-head, dye carrying film receiver and dye receptive reverse transfer film receiver, the controller being configured to:

receive a primary image and a visual security image to be printed on the security card;

print the primary image onto a receiving layer of a dye receptive reverse transfer film;

print the security image onto the receiving layer of the dye receptive reverse transfer film by transferring overcoat resin from the overcoat panel of the dye carrying film onto the receiving layer of the dye receptive reverse transfer film in a pattern, the pattern forming the visual security image;

transfer the reverse transfer film to a surface of a security card; and bond the reverse transfer film to the security card.

16. A printer according to claim 15, wherein the controller is configured to print the visual security image onto the receiving layer by heating the print-head and applying pressure from the print-head to the overcoat panel, the heat and pressure being sufficient to transfer desired portions of overcoat resin from the overcoat panel onto the receiving layer to form the pattern.

17. A printer according to claim 16, wherein the controller is configured to print the visual security image onto the receiving layer by dithering the print-head to produce a dithered pattern, the dithered pattern forming the visual security image.

18. A printer according to claim 16, wherein the controller uses a model to control the heating of the print-head during printing, the model defining heat energy properties of each of a plurality of printing elements comprising the print-head of the printer.

19. A printer according to claim 16, wherein the controller is configured to print the visual security image onto the receiving layer by heating the print-head and applying pressure from the print-head to the overcoat panel, the heat and pressure being sufficient to transfer desired portions of overcoat resin and overcoat panel receiving layer from the overcoat panel onto the receiving layer of the reverse transfer film to form the pattern, where the overcoat panel receiving layer carries the overcoat resin on, the dye carrying film.

20. A printer according to claim 15, wherein the controller is configured to print the visual security image onto the receiving layer by heating the print-head and applying pressure from the print-head to the overcoat panel, the beat and pressure being sufficient to transfer desired portions of overcoat resin and overcoat panel receiving layer from the overcoat panel onto the receiving layer of the reverse transfer film to form the pattern, where the overcoat panel receiving layer carries the overcoat resin on the dye carrying film.

21. A printer according to claim 15, wherein the visual security image is encrypted with an encryption key for preventing unauthorized printing of the visual security image.

22. A printer according to claim 21, wherein, when authorized to print the encrypted visual security image, the controller is configured to decrypt the encrypted security image using a decryption key stored local to the printer prior to printing the visual security image.

23. A printer according to claim 15, wherein the controller is configured to print the primary image onto the receiving layer by heating the print-head and applying pressure from the print-head to each of the Yellow, Magenta, Cyan, and Black (YMCK) panels of the dye carrying film in sequence, the heat and pressure being sufficient to transfer desired portions of each of the YMCK dyes from the respective YMCK panels onto the receiving layer to form the printed primary image on the receiving layer.

24. A printer according to claim 15, wherein the printer prints the primary image before printing the visual security image.

25. A printer according to claim 15, wherein the printer prints the visual security image before printing the primary image.

* * * * *